United States Patent [19]

McCormick et al.

[11] Patent Number: 4,471,697

[45] Date of Patent: Sep. 18, 1984

[54] BIDIRECTIONAL SLAPPER DETONATOR

[75] Inventors: Robert N. McCormick; Melissa D. Boyd, both of Los Alamos, N. Mex.

[73] Assignee: The United States of America as represented by the United States Department of Energy, Washington, D.C.

[21] Appl. No.: 343,613

[22] Filed: Jan. 28, 1982

[51] Int. Cl.[3] ..... F42C 19/12

[52] U.S. Cl. ..... 102/202.14; 102/200; 102/202.5

[58] Field of Search ..... 102/202.5, 202.7, 202.14, 102/200, 204, 206, 221, 275.4

[56] References Cited

U.S. PATENT DOCUMENTS

| | | | |
|---|---|---|---|
| 1,598,920 | 9/1926 | Mallet | 102/275.4 |
| 3,978,791 | 9/1976 | Lemley et al. | 102/202.14 |
| 4,089,268 | 5/1978 | Jaroska et al. | 102/221 |
| 4,144,814 | 3/1979 | Day et al. | 102/202.14 |
| 4,312,271 | 1/1982 | Day et al. | 102/202.14 |

OTHER PUBLICATIONS

Stroud, John R.; "A New Kind of Detonator—The Slapper"; UERL-77639; Apr. 1, 1976.

*Primary Examiner*—Charles T. Jordan

*Attorney, Agent, or Firm*—Leonard C. Brenner; Paul D. Gaetjens; Michael F. Esposito

[57] ABSTRACT

The disclosure is directed to a bidirectional slapper detonator. One embodiment utilizes a single bridge circuit to detonate a pair of opposing initiating pellets. A line generator embodiment uses a plurality of bridges in electrical series to generate opposing cylindrical wavefronts.

2 Claims, 6 Drawing Figures

BIDIRECTIONAL SLAPPER DETONATOR

BACKGROUND OF THE INVENTION

The field of the invention relates to slapper detonators and more particularly to bidirectional slapper detonators. This invention is the result of a contract with the Department of Energy (Contract No. W-7405-ENG-36).

Slapper detonators are used to detonate high explosive charges, particularly relatively insensitive high explosives.

One of the prior art slapper detonators uses a fragment, flyer or slapper driven across a gap to impact a single explosive acceptor charge. The slapper is driven across the gap by an electrically exploded metal foil. In accordance with the invention, a single electrically exploded metal foil can be utilized to simultaneously propel two slappers in opposite directions.

SUMMARY OF THE INVENTION

One object of the present invention is to simultaneously detonate two opposed high explosive charges.

Another object of the invention is to provide good uniform hemispherical detonation simultaneously in two opposing directions.

One advantage of the present invention is that it can be used to reliably detonate at least two oppositely disposed high explosive charges.

Another advantage of the instant invention is that only half as many electrically exploded metal foil circuits need be utilized to detonate a given number of high explosive charges.

To achieve the foregoing and other objects, and in accordance with the purposes of the present invention, as embodied and broadly described herein, the apparatus of this invention may comprise a bridge element, slappers disposed on opposing sides of the bridge element, and an initiating pellet adjacent to each slapper. Opposing barrel holders and barrels, such as sapphire barrels, may be utilized to space each slapper from the high explosive it is to detonate. The invention can be utilized in line generators. Additional objects, advantages, and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an embodiment of the present invention and, together with the description, serve to explain the principles of the invention.

In the drawings.

DETAILED DESCRIPTION OF A PREFERRED EMBODIMENT OF THE INVENTION

Figure 1:
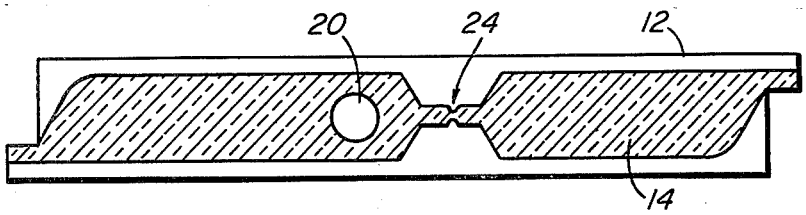
FIG. 1 illustrates a simple electrical circuit on a slapper base.
Figure 2:
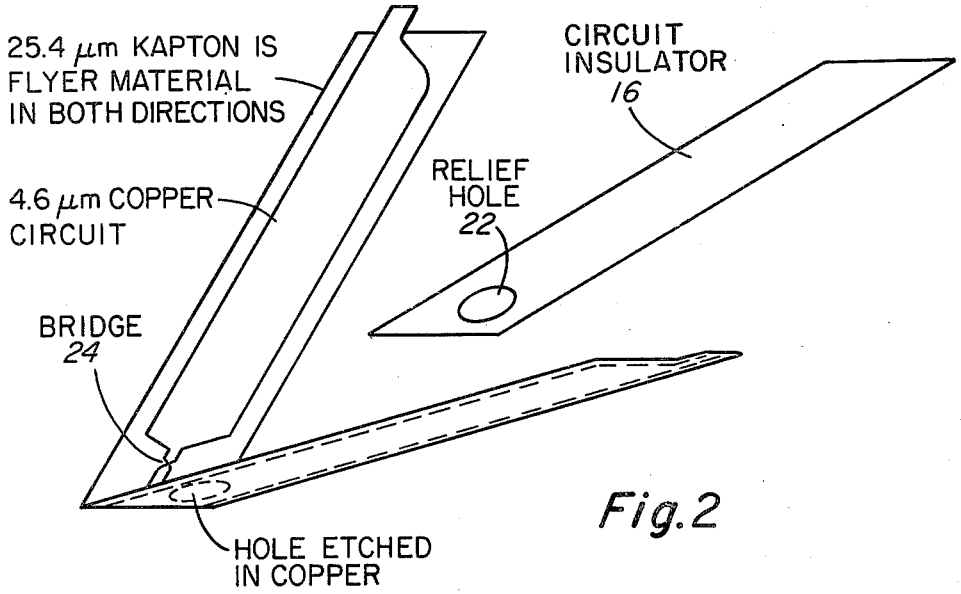
FIG. 2 shows the FIG. 1 circuit partially folded with a circuit insulator to be inserted into the fold.

With reference to FIG. 1, a copper circuit such as one comprising a layer of copper 14 approximately 4.6 μm thick is disposed on a base or laminate of, for example, 25.4 μm thick Kapton. Kapton is a trademark of Dupont for its brand of the material polyimide. Although, for purposes of illustration, copper is shown, those skilled in the art will appreciate that other suitable conductors, such as silver and aluminum, may also be utilized. Too, although Kapton is used as a base, those skilled in the art will realize that other materials, such as plastic films and synthetic resin polymer films, may also be used. As seen in FIG. 2, the circuit is folded on itself around a circuit insulator 16. Relief apertures 20, and 22 provide for the foldover configuration where the Kapton layer 12 can be utilized as a flyer or slapper on either side of a bridge 24, which is the part of the copper that is electrically vaporized to propel the flyers as hereinafter described. Bridge 24 is covered on both sides of the preferred embodiment with just 25.4 μm of Kapton plus a thin layer of glue on side 12 to which the copper is disposed. Those of ordinary skill in the art will appreciate that the layer of glue between the bridge and the flyer must be very thin so that the flyer with the glue is propelled with essentially the same velocity as the flyer without the glue.

Figure 3:
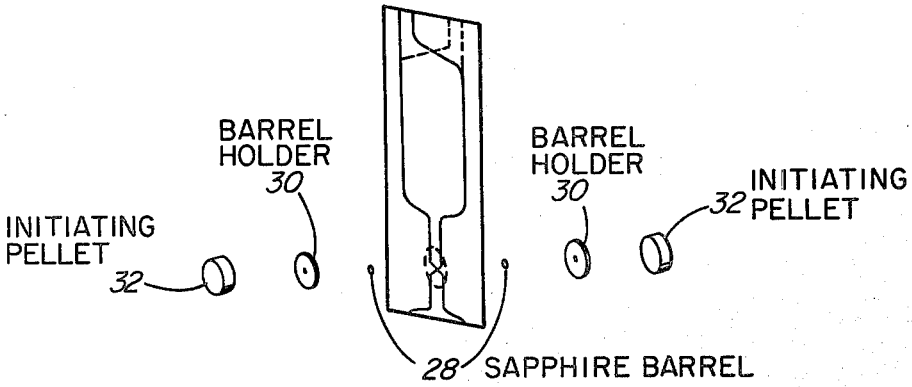
FIG. 3 shows an exemplary bidirectional slapper detonator in an exploded view.

In the preferred embodiment shown in FIG. 3, barrels such as sapphire barrels 28 are disposed in barrel holders 30. The reason that sapphire barrels are used is that sapphire cuts the flyer evenly and aids in directing it toward initiating pellets 32. The sapphire barrels are of small size, rather inexpensive, and may be made perfectly round. In a preferred embodiment, the dimensions may be as follows:

BRIDGE: 0.381 mm square bridge, $\frac{1}{8}$ oz. copper

PELLEt: 1.65 g/cm$^3$ PETN 93 mm long×12.7 mm diameter

BARREL HOLDER: 9.52 mm dia.×0.318 mm long, 0.965 mm dia. aperture

BARREL: sapphire, 0.965 mm dia.×0.356 mm long, 0.406 mm dia. aperture

FLYER: 25.4 μm Kapton, both sides of bridge

Figure 4:
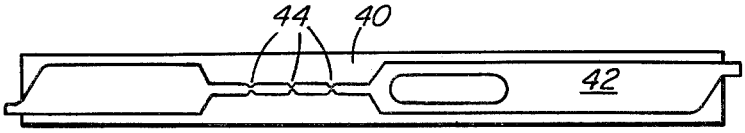
FIGS. 4 and 5 depict a line generator embodiment of the invention.
Figure 5:
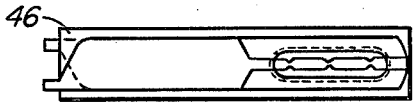
Figure 6:
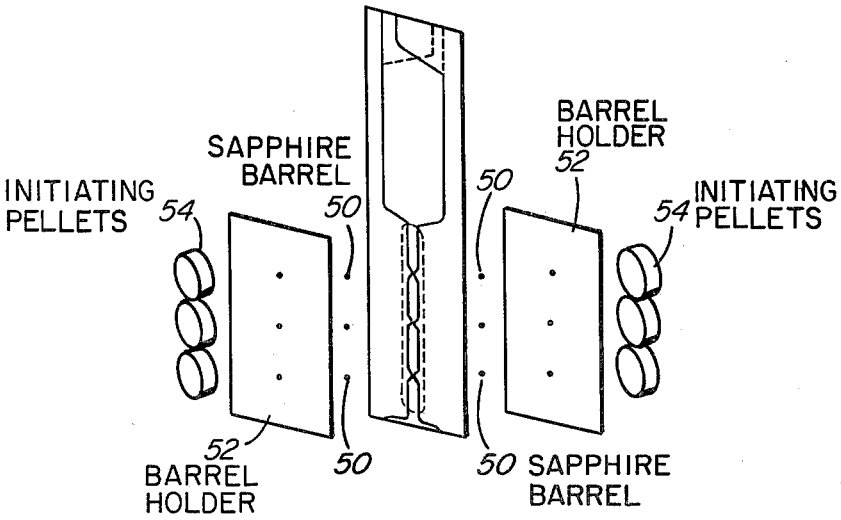
FIG. 6 illustrates a line generator in accordance with the invention in an exploded view.

The instant invention can also be utilized in the construction of line generators. Line generators comprise a series of bridges and are utilized to provide essentially cylindrical detonation fronts. In contrast, a single detonator, as shown in FIG. 3, provides an essentially hemispherical detonation front on each side of the detonator. FIGS. 4 and 5 illustrate construction of a line generator utilizing a base 40, copper cladding 42, and bridges 44. Again, the base with the copper cladding is folded over itself using an insulating divider 46, as seen in FIG. 5. Those skilled in the art will realize that although three bridges are shown for purposes of illustration, any number, such as 2–6 or more, can be utilized to practice the invention. The fewer bridge circuits there are, the less electrical energy is needed to successfully fire the detonator. It does take more energy to fire, for example, a six bridge circuit than it does to fire a three bridge circuit. As seen in FIG. 6, barrels such as sapphire barrels 50 can be utilized in barrel holders 52 to fire a series of initiating pellets 54.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A bidirectional slapper detonator comprising:

a bridge element sandwiched between two barrel holders;

a sapphire barrel disposed in each barrel holder;

a flyer between said bridge element and each of said barrels; and an initiating pellet adjacent each barrel and barrel holder.

2. A birdirectional slapper detonator comprising:

a plurality of bridge elements disposed in a line;

a pair of barrel holders adjacent each of said bridge elements on opposite sides thereof;

a sapphire barrel disposed in each of said barrel holders;

a flyer disposed between each of said bridge elements and each of said barrels; and an initiating pellet adjacent each of said barrels and said barrel holders.

* * * * *